United States Patent [19]

Yamamoto

[11] 4,014,149

[45] Mar. 29, 1977

[54] PANELED DOOR CONSTRUCTION

[75] Inventor: Yukio Yamamoto, Kurobe, Japan

[73] Assignee: Yoshida Kogyo Kabushiki Kaisha, Tokyo, Japan

[22] Filed: Oct. 9, 1975

[21] Appl. No.: 620,936

[30] Foreign Application Priority Data

Oct. 11, 1974 Japan ..... 49-123444[U]

[52] U.S. Cl. ..... 52/456; 52/620; 52/624

[51] Int. Cl.[2] ..... E04C 2/38

[58] Field of Search ..... 52/615, 619, 620, 624, 52/627, 629, 455–458

[56] References Cited

UNITED STATES PATENTS

| | | | |
|---|---|---|---|
| 977,366 | 11/1910 | Breakey | 52/615 |
| 1,694,522 | 12/1928 | Victor | 52/620 |
| 1,708,351 | 4/1929 | Auld | 52/619 |
| 1,917,871 | 7/1933 | Birt | 52/615 |
| 2,040,259 | 5/1936 | Johnson | 52/615 |
| 2,423,199 | 7/1947 | Milnor | 52/627 |
| 2,567,357 | 9/1951 | Turner | 52/627 |
| 2,692,664 | 10/1954 | Ternes | 52/627 |
| 3,082,849 | 3/1963 | Keller | 52/615 |

*Primary Examiner*—Price C. Faw, Jr.
*Assistant Examiner*—Henry Raduazo
*Attorney, Agent, or Firm*—Hill, Gross, Simpson, Van Santen, Steadman. Chiara & Simpson

[57] ABSTRACT

A paneled door construction comprises a pair of first and second stiles, top and bottom rails connecting the stiles together, a muntin extending vertically between the top and bottom rails, and a pair of block assemblies disposed between the first stile and the muntin, and between the second stile and the muntin, respectively. The block assemblies each include a pair of inner stiles spaced apart horizontally from each other and extending vertically between the top and bottom rails, and alternate blocks and block-parting members sandwiched between the inner stiles. The blocks and block-parting members are attached by screws to the inner stiles by bringing the former into contact with the inner stiles, and then threading said screws into the blocks and the block-parting members through the inner stiles.

3 Claims, 3 Drawing Figures

PANELED DOOR CONSTRUCTION

BACKGROUND OF THE INVENTION

Field of the Invention

This invention relates to doors and more particularly to a paneled door construction which is built of frame members with the spaces therebetween filled with panels formed by casting, die-casting or pressing.

Prior Art

Paneled door constructions of the type described comprise a pair of upright frame members or stiles, top and bottom frame members or rails interconnecting the top ends and bottom ends of the stiles, respectively, and parting members extending horizontally between stiles, with the spaces defined between these door frame members filled with molded panels or blocks which form part of the door surfaces. The prior art paneled door constructions were assembled in such a manner that the stiles and bottom rail are first interconnected, and the panels or blocks and parting members are then alternately inserted into and between the stiles. After all the panels or blocks were assembled, the top rail was attached to secure the stiles together by bolts so as to complete the paneled door constructions. Such conventional door constructions required very tedious and time-consuming assembly operations especially for the infilling of panels or blocks.

SUMMARY OF THE INVENTION

It is therefore the primary object of the invention to provide a paneled door construction which can be assembled with maximum ease.

Briefly stated, the present invention provides a paneled door construction comprising a pair of stiles, top and bottom rails connecting said stiles together, and a block assembly disposed between said stiles, said block assembly including a pair of inner stiles spaced apart horizontally from each other and extending vertically between said top and bottom rails, and alternate blocks and block-parting members sandwiched between said inner stiles, said blocks and block-parting members being attached by screws to said inner stiles by bringing the former into contact with the inner stiles and then threading said screws into the blocks and the block-aparting members through the inner stiles.

The above and other objects and features of the invention will appear clear from the following description taken in conjunction with the accompanying drawings illustrating a preferred embodiment which the invention may assume in practice.

DETAILED DESCRIPTION OF THE PREFERRED EMBODIMENT

Figure 1:
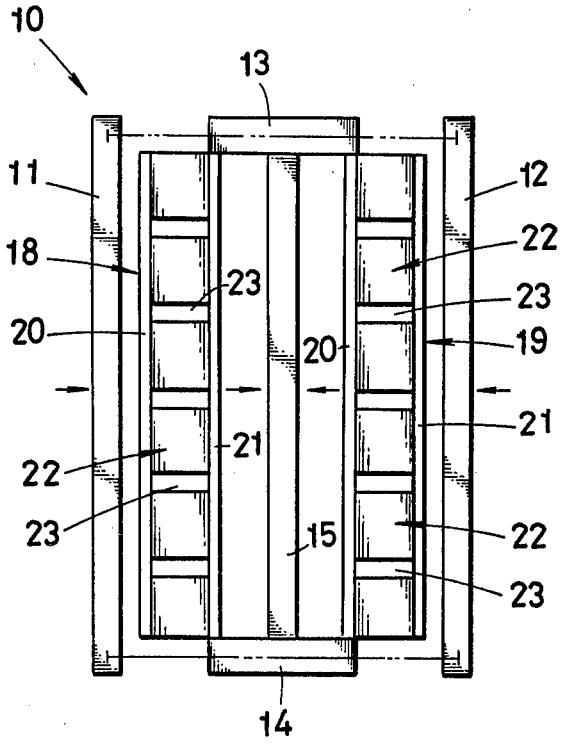
FIG. 1 is an exploded, front elevational view of a paneled door construction according to the invention, which illustrates the manner in which the door construction is assembled.
Figure 2:
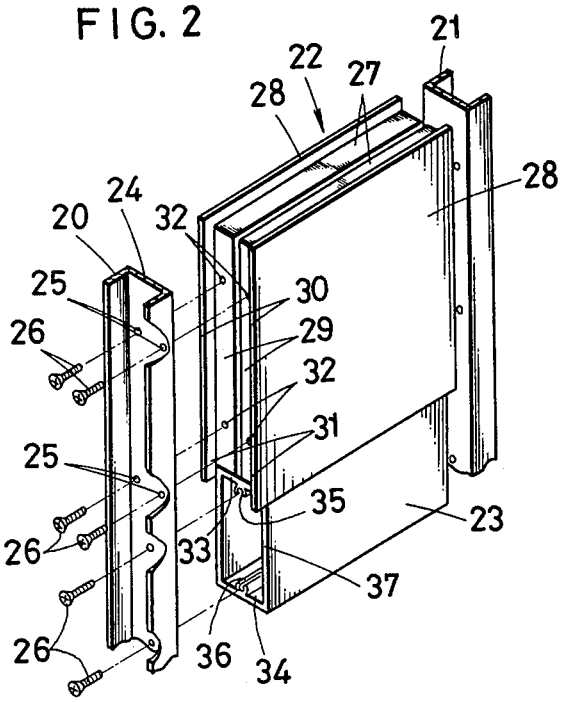
FIG. 2 is an exploded, perspective view, on an enlarged scale, of panels disposed for ready attachment to inner stile members.

In FIGS. 1 and 2, there is shown a paneled door construction generally indicated at 10 which includes a pair of vertically extending outer stiles 11 and 12, a pair of top and bottom rails 13 and 14 extending horizontally for interconnecting the top ends and the bottom ends of the outer stiles 11, 12, respectively, and an intermediate muntin 15 extending vertically between the top and bottom rails 13, 14, these frame members forming an outer framework of the door construction 10. The outer stiles 11, 12 and the muntin 15 are provided with one or two pairs of inwardly extending flanges 16 and 17 (FIG. 3), respectively. Generally designated at 18 and 19 are a pair of block assemblies interposed between the stile 11 and the muntin 15, and between the stile 12 and muntin 15, respectively. Each of the block assemblies 18 and 19 comprises a pair of inner stiles 20 and 21 spaced apart horizontally from each other and extending vertically between the top and bottom rails 13, 14, and a series of alternate blocks 22 and block-parting members 23 sandwiched between the inner stiles 20 and 21 and extending between the top and bottom rails 13 and 14.

As better shown in FIG. 2, each of the inner stiles 20 and 21 is of a channel cross-section and has a bottom 24 with a number of holes 25 formed therethrough for passing a number of screws 26 which secure the inner stiles 20, 21, the blocks 20 and the block-parting members 23 tightly together. The blocks 22 each comprise a pair of opposed identical panels 27 each including a square plate 28 forming part of the door surface, each of the plates 28 having a pair of walls 29 formed integral with and adjacent to its marginal edges 30 and extending at right angles to the plane of the plate 28 toward the walls 29 of the opposed panel 27. The walls 29 are displaced from the marginal edges 30 of the plate 28 to provide two pairs of flanges 31 extending outwardly beyond the walls 29. The walls 29, which face in opposite relation to the bottoms 24 of the inner stile 18, (19), are provided with a number of tapped holes 32 formed therethrough for receiving the screws 26 which extend through the holes 25 in the inner stile bottoms 24. The block-parting members 23 are hollow and cross-sectionally rectangular, and have a length substantially equal to the distance between the oppositely disposed walls 29 of either of the panels 27. Formed integral with a pair of walls 33 and 34 of the parting member 23 are a pair of sockets 35 and 36, respectively, extending longitudinally from an edge 37 toward the interior of the hollow parting member 23 and adapted to receive therein other of the screws 26.

Figure 3:
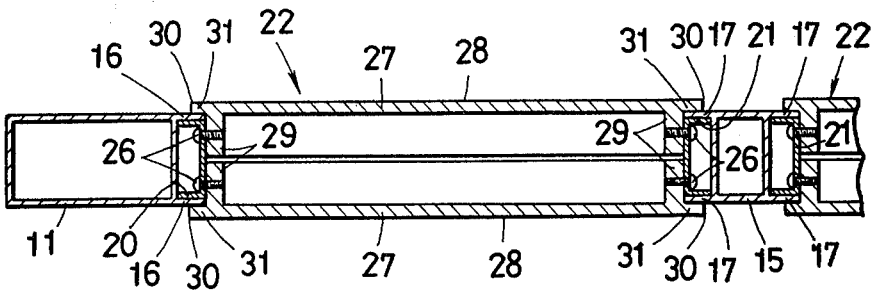
FIG. 3 is a fragmentary, horizontal cross-sectional view, on an enlarged scale, of the door construction assembled.

When assembling the paneled door construction 10, one block 22 or one pair of panels 27 is attached to the oppositely disposed inner stiles 20 and 21 by bringing the apertured walls 29 of the panels 27 into contact with the bottoms 24 of the inner stiles 20 and 21, and then the screws 26 are threaded into the tapped holes 32 in the panel walls 29 through the holes 25 in the inner stile bottoms 24. Then, the block-parting member 23 is arranged adjacent the mated panels 27, and is secured to the inner stiles 20 and 21 by the screws 26 which are threadedly engageable with the sockets 35 and 36. In this manner, the blocks 22 and block-parting members 23 are alternately and sequentially attached to the opposed inner stiles 20 and 21 in order to complete the block assemblies 18 and 19 which are in turn attached to and held in place within the outer framework so that the flanges 16 of the outer stile 11 (12) and the flanges 17 of the muntin 15 are fitted between the panel flanges 31 and the inner stile 20, and between the panel flanges 31 and the inner stile 21, respectively, as best shown in FIG. 3. The outer framework having included therein the block assemblies 18 and 19 is thereafter formed into an integral body or unit by connecting the top and bottom ends of the outer stiles 11, 12 with the top and bottom rails 13, 14 by means of bolts indicated diagrammatically in FIG. 1.

With this arrangement, the paneled door construction 10 can be easily assembled since the individually prefabricated block assemblies 18, 19 are attached to the outer framework. Also advantageously, the screws 26 are disposed within and concealed by the inner stiles 20, 21, as shown in FIG. 3. Furthermore, the panels 27 can be readily replaced when damaged, because they are mounted in position by means of screws, not by adhesive bonding or riveting.

What is claimed is:

1. A paneled door construction comprising:

a. a first pair of stiles having exposed outer surfaces;

b. top and bottom rails having exposed outer surfaces connecting said stiles together; and c. a block assembly disposed between said stiles, said block assembly including, 1. A pair of inner stiles spaced apart horizontally from each other and extending vertically between said top and bottom rails, and disposed in and concealed by said first pair of exposed stiles, 2. alternate externally exposed blocks and exposed block-parting members sandwiched between and engaging said inner stiles, the periphery of each block overhanging said first exposed stiles and the adjacent block-parting members or rail, and 3. screws extending through said inner stiles into the blocks and the block-parting members.

2. A paneled door construction as defined in claim 1, wherein said blocks each comprise a pair of opposed identical panels.

3. A paneled door construction comprising:

a. a pair of first and second stiles;

b. top and bottom rails connecting said stiles together;

c. a muntin extending vertically between said top and bottom rails; and d. a pair of block assemblies disposed between said first stile and said muntin, and between said second stile and said muntin, respectively, said block assemblies each including 1. a pair of inner stiles spaced apart horizontally from each other and extending vertically between said top and bottom rails, 2. alternate blocks and block-parting members sandwiched between and engaging said inner stiles, and 3. screws extending through said inner stiles into the blocks and the block-parting members.

* * * * *